US005163711A

United States Patent [19]

Philips et al.

[11] Patent Number: 5,163,711

[45] Date of Patent: Nov. 17, 1992

[54] IDENTIFICATION PLATE FOR EQUIPMENT, ESPECIALLY DATA-PROCESSING EQUIPMENT

[76] Inventors: Frédérick Philips, 12 Avenue Parmentier, 75011 Paris; Christophe Latour, 5 bis, Grande Rue, 78150 La Celle Saint Cloud, both of France

[21] Appl. No.: 722,144

[22] Filed: Jun. 27, 1991

[30] Foreign Application Priority Data

Jun. 29, 1990 [FR] France ..... 90 08265

[51] Int. Cl.[5] ..... B42D 15/00

[52] U.S. Cl. ..... 283/101; 283/81; 283/108

[58] Field of Search ..... 283/81, 101, 95, 96, 283/108

[56] References Cited

U.S. PATENT DOCUMENTS 2,225,520 12/1940 Eisenberg .
3,487,567 1/1970 Waybright ..... 283/108
3,631,617 1/1972 Pekko .
4,180,929 1/1980 Schultz, Jr. ..... 283/108
4,432,630 2/1984 Haas ..... 283/81 X

FOREIGN PATENT DOCUMENTS 2613131 10/1977 Fed. Rep. of Germany ..... 283/108
85244740 11/1985 Fed. Rep. of Germany .
2369639 5/1978 France .

*Primary Examiner*—Paul A. Bell
*Attorney, Agent, or Firm*—Wenderoth, Lind & Ponack

[57] ABSTRACT

Equipment identification plate, carries, in a first zone of one of its faces, an identification number, and in a second zone, information relating to the identification authority to which it is appropriate to apply in order to obtain particulars relating to the holder of the identification number. The other face of the plate is adhesive, and bears an inscription transferable by adhesive bonding onto a wall of the equipment to be identified during the fitting of the plate, and is capable of appearing unalterably should the plate be torn off so as to indicate the theft of the equipment.

11 Claims, 2 Drawing Sheets

IDENTIFICATION PLATE FOR EQUIPMENT, ESPECIALLY DATA-PROCESSING EQUIPMENT

BACKGROUND OF THE INVENTION

The present invention relates to the protection of equipment against theft, and is concerned more particularly with the "tattooing" of equipment, especially of data-processing and office equipment.

The identification of data-processing or like equipment is traditionally obtained by means of a serial number carried by a self-adhesive label fastened to the housing of the appliance, which label can easily be removed.

The equipment is therefore not properly protected against theft, with the result that, each year, thousands of microcomputers disappear from companies.

SUMMARY OF THE INVENTION

The object of the invention is to remedy this lack of protection by providing a means which makes it possible, on the one hand, to give equipment an identification number and, on the other hand, to make this identification number virtually unalterable, so that the equipment carrying it can be identified at any moment.

The subject of the invention is, therefore, an identification plate for equipment which carries, in a first zone of a first face, an identification number, and in a second zone, information relating to the identification authority to which it is appropriate to apply in order to obtain particulars relating to the holder of the identification number. The other face of the plate is adhesive and bears an inscription transferable by adhesive bonding onto a wall of the equipment to be identified during the fitting of the plate and is capable of appearing unalterably should the plate be torn off, in order to indicate the theft of the equipment.

BRIEF DESCRIPTION OF THE DRAWINGS

The invention, will be understood better from the following description given purely by way of example, and made with reference to the accompanying drawings, in which.

DETAILED DESCRIPTION OF THE PREFERRED EMBODIMENTS

Figure 1:
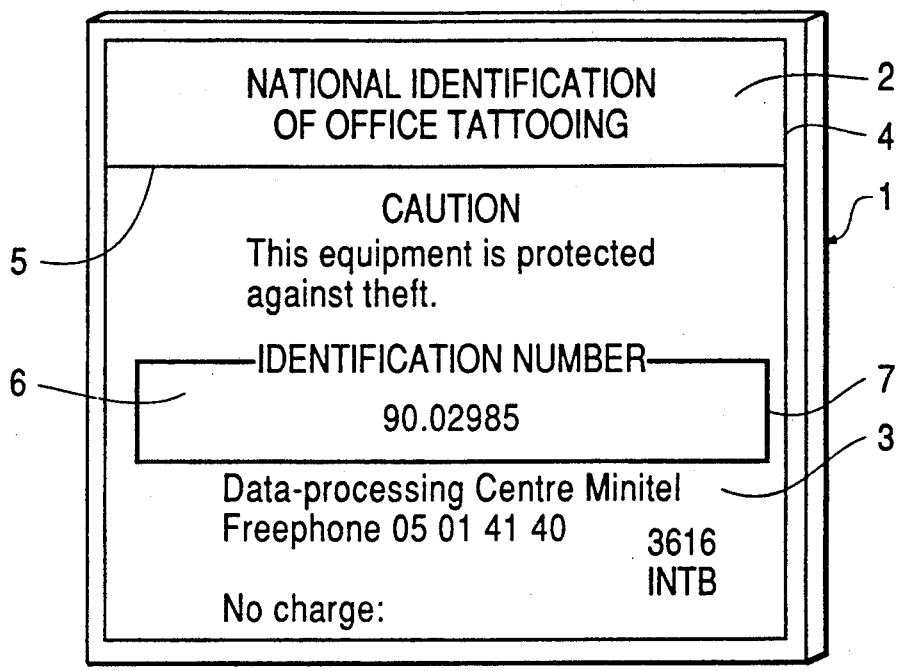
FIG. 1 is a plan view of the front of the identification plate according to the invention.

FIG. 1 illustrates a plate 1 which is produced, for example, from light alloy and the front of which is subdivided into two main zones 2 and 3 delimited by an outer frame 4 and a horizontal separating line 5.

The zone 2 bears a inscription relating to the name of the authority making the plate in question.

In the present example, this authority is entitled "national identification of office tattooing".

Next to this inscription can appear a logo of the authority.

The zone 3 comprises a central area 6 which is delimited by a rectangular frame 7 and in which is inscribed the identification number of the plate and consequently of the appliance intended for receiving the plate.

Above the identification number the statement "Caution, this equipment is protected against theft" can be read.

Below the frame 7 containing the identification number is information relating to the data-processing center, to which it is possible to apply in order, for example, to ascertain the holder of the identification number carried by the plate or to provide notification of the theft of the equipment identified by this number.

The inscriptions located in zones 2 and 3 are advantageously made by vapour-phase deposition of a material.

Figure 2:
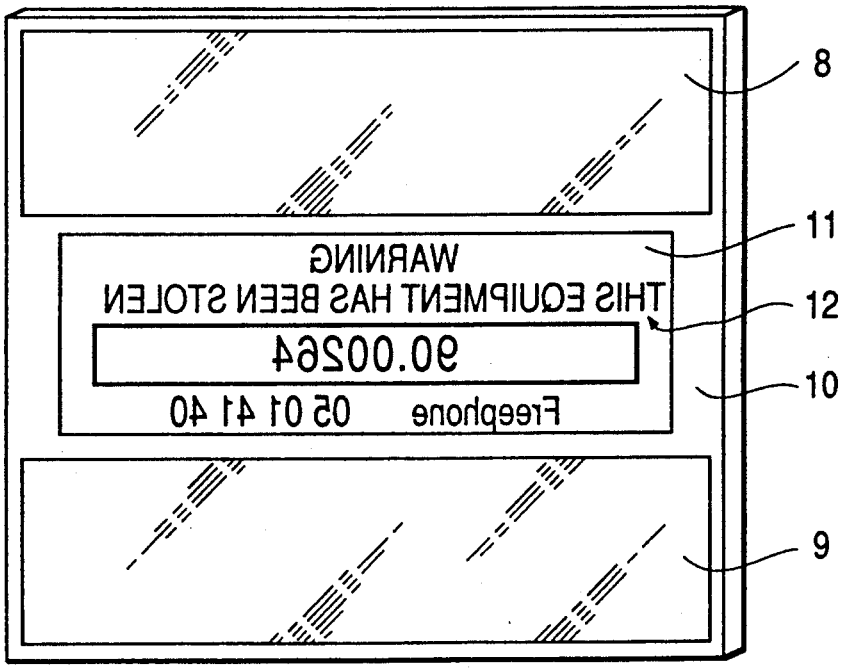
FIG. 2 is a plan view of the back of the identification plate of FIG. 1.

FIG. 2 illustrates the back of the plate of FIG. 1.

This rear face of the plate comprises two adhesive lateral zones 8 and 9, on which are placed, for example, double-face adhesives. The adhesive used is, for example, type 94.73 of the 3M brand. The setting time of this adhesive is 15 s, and the highest possible tearing strength is obtained after 24 hours.

This adhesive withstands temperatures of between −50° and +100° C., so that an attempt to tear off the plate manually is virtually impossible and would risk leaving traces.

Between the two zones 8 and 9 carrying the double-face adhesives is a central zone 10, to which is fastened a strip of thermostabilised plastic film 11. Onto the film 11 is printed back to front, for example by means of a laser printer, an inscription 12 intended for warning that the equipment has been stolen, accompanied by the same identification number as that printed on the front in frame 7.

The fitting of the plate just described with reference to FIGS. 1 and 2 is carried out as follows.

Central zone 10 of the back of the plate 1 is coated with a glue, such as, for example, a cyanoacrylate glue in gel form, for example of the Loctite 454 gel type, produced and sold by Messrs Framet, and the protective strips of the two surfaces 8, 9 provided with their double-face adhesive are removed.

The plate is then laid onto a wall, for example made of plastic, of the housing of the electric equipment to be protected. The two zones 8 and 9 carrying the double-face adhesive adhere quickly to the wall of the housing, and the strip of plastic film 10 bearing the inscriptions printed back to front is adhesively bonded to the wall by means of the cyanoacrylate gel glue, in such a way that the film bearing the characters is transferred and virtually incorporated together with the glue into the plastic of the housing of the equipment.

The film 10 is adhesively bonded to the wall of the housing at the moment when the plate 1 is fastened to the housing. The setting time of the cyanoacrylate glue is 10 s and the final strength is obtained after 12 hours.

Of course, the presence of this warning inscription is invisible since it is concealed by the metal plate 1.

According to a version not shown, the plate and the plastic strip can have a logo and/or symbol identifying the company to which the equipment belongs and a bar code to make it possible to carry out easier management of the equipment of a company.

Figure 3:
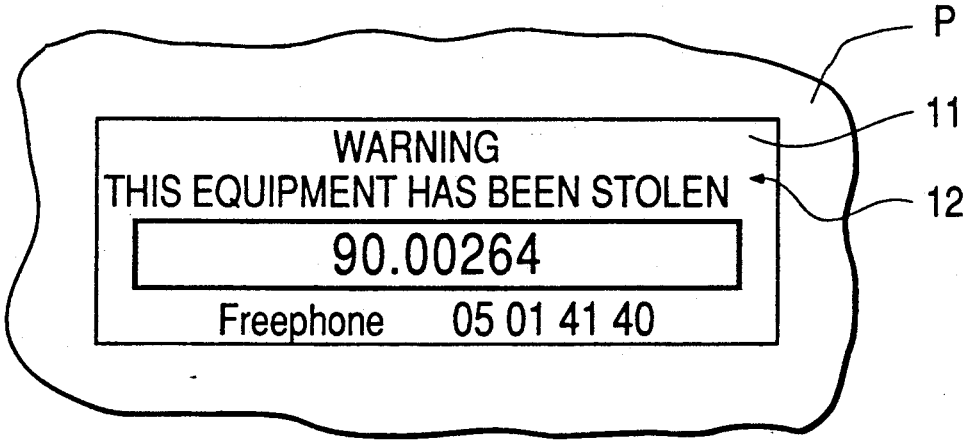
FIG. 3 is a partial elevation view of a panel of an appliance from which the identification plate of FIGS. 1 and 2 has been torn off.

FIG. 3 shows a partial view of the wall P of equipment which is identified by means of the plate according to the invention the plate of which has been torn off. It can be seen that the tearing off of the plate has left, incorporated in the wall of the appliance, the plastic film 11 bearing the inscription warning of the theft of the equipment, the identification number of this equipment and the call number of the data-processing management authority for the equipment. These inscriptions are incorporated in the wall P of the housing so intimately that it is virtually impossible to erase them without damaging the wall carrying them.

It can thus be seen that the arrangement as described provides an extremely effective means of ensuring the identification of an appliance or equipment of some value. The identification by means of a plate fastened virtually unremovably to the housing of the equipment constitutes a means of particular deterrence against theft.

Although, in the example described, the invention is considered as being used for the protection of data-processing equipment, it goes without saying that it can also be used for any equipment justifying such safety measures.

We claim:

1. An identification plate, comprising:

a plate having a front face and a rear face;

a first zone defined on said front face of said plate, said first zone having an identification number thereon;

a second zone defined on said front face of said plate, said second zone containing identification authority information thereon;

a first adhesive on said rear face of said plate for bonding said plate to a piece of equipment to be identified; and a film bearing an inscription disposed on said rear face of said plate; a second adhesive for bonding said film to the piece of equipment to be identified when said plate is bonded to the piece of equipment, said second adhesive being stronger than said first adhesive such that said film will remain on the piece of equipment and show said inscription if said plate is subsequently removed from the piece of equipment.

2. The identification plate of claim 1, wherein said identification number in said first zone and said identification authority information in said second zone are both a vapor-phase deposit on said front face of said plate.

3. The identification plate of claim 1, wherein said rear face of said plate has two laterally spaced zones and said adhesive on said rear face is a double-faced adhesive provided in said zones.

4. The identification plate of claim 3, wherein said rear face of said adhesive plate further has a central zone between said two laterally spaced zones with said film bearing said inscription thereon.

5. The identification plate of claim 4, wherein said film bearing said inscription comprises a plastic film fastened to said rear face of said plate.

6. The identification plate of claim 5, wherein said inscription on said plastic film comprises characters laser printed back to front on said plastic film.

7. The identification plate of claim 6, wherein said second adhesive for bonding said plastic film to the piece of equipment to be identified is a cyanoacrylate glue in gel form.

8. The identification plate of claim 4, wherein both said first zone and said film bearing said inscription further have owner identification information and a bar code provided thereon.

9. An identification plate, comprising:

a plate having a front face and a rear face;

a first zone defined on said front face of said plate, said first zone having an identification number thereon;

a second zone defined on said front face of said plate, said second zone containing identification authority information thereon;

adhesive on said rear face of said plate for bonding said plate to a piece of equipment to be identified; and a film fastened to said rear face of said plate having an inscription thereon, said film having a second adhesive on a side thereof facing away from said plate for bonding said film to the piece of equipment to be identified wherein said second adhesive provides a stronger bond for said plastic film than the first said adhesive provides for said plate.

10. The identification plate of claim 9, wherein said film is located between two zones of the first said adhesive.

11. The identification plate of claim 10, wherein said second adhesive is a cyanoacrylate glue in gel form.

* * * * *